US011149659B2

(12) United States Patent
Stec et al.

(10) Patent No.: US 11,149,659 B2
(45) Date of Patent: Oct. 19, 2021

(54) SELF-CONTAINED COMPRESSION BRAKE CONTROL MODULE FOR COMPRESSION-RELEASE BRAKE SYSTEM OF AN INTERNAL COMBUSTION ENGINE

(71) Applicant: Pacbrake Company, Blaine, WA (US)

(72) Inventors: Peter Stec, Vancouver (CA); Kody Taylor, Surrey (CA); Devin Batcheller, Surrey (CA)

(73) Assignee: Pacbrake Company, Blaine, WA (US)

( * ) Notice: Subject to any disclaimer, the term of this patent is extended or adjusted under 35 U.S.C. 154(b) by 0 days.

(21) Appl. No.: 16/952,483

(22) Filed: Nov. 19, 2020

(65) Prior Publication Data

US 2021/0156319 A1 May 27, 2021

Related U.S. Application Data

(60) Provisional application No. 62/938,595, filed on Nov. 21, 2019.

(51) Int. Cl.
*F01L 13/06* (2006.01)
*F02D 13/04* (2006.01)
(Continued)

(52) U.S. Cl.
CPC ..... *F02D 13/04* (2013.01); *F01L 1/24* (2013.01); *F01L 13/06* (2013.01);
(Continued)

(58) Field of Classification Search
CPC ..... F01L 1/24; F01L 1/267; F01L 1/46; F01L 13/06; F02D 13/0246; F02D 13/04
(Continued)

(56) References Cited

U.S. PATENT DOCUMENTS 4,996,957 A 3/1991 Meistrick
5,992,376 A * 11/1999 Okada ..... F02D 13/04 123/321

(Continued)

FOREIGN PATENT DOCUMENTS

WO 2016041600 A1 3/2016

OTHER PUBLICATIONS

International Search Report dated Mar. 16, 2021—Corresponding PCT Application No. PCT/US2020/061208.

*Primary Examiner* — Jorge L Leon, Jr.
(74) *Attorney, Agent, or Firm* — Berenato & White, LLC

(57) ABSTRACT

A compression-release brake system for operating an exhaust valve of an engine during an engine braking operation. The compression-release brake system comprises a self-contained compression brake control module (CBCM) operatively coupled to the exhaust valve for controlling a lift and a phase angle thereof. The CBCM includes a casing defining an actuator cavity, a actuation piston disposed outside the casing so as to define an actuation piston cavity between the casing and the actuation piston, and a check valve provided between the actuation piston cavity and a compression brake actuator disposed in the actuator cavity. The actuation piston reciprocates relative to the casing. The compression brake actuator includes an actuator element and a biasing spring. The actuator element selectively engages the check valve when deactivated so as to unlock the actuation piston cavity and disengages from the check valve when activated so as to lock the actuation piston cavity.

12 Claims, 9 Drawing Sheets

(51) Int. Cl.
*F01L 1/24* (2006.01)
*F02D 13/02* (2006.01)
*F01L 1/26* (2006.01)

(52) U.S. Cl.
CPC ..... *F02D 13/0246* (2013.01); *F01L 1/26* (2013.01); *F01L 2001/2444* (2013.01)

(58) Field of Classification Search
USPC ..... 123/90.12, 90.15, 90.4
See application file for complete search history.

(56) References Cited

U.S. PATENT DOCUMENTS

| | | | | |
|---|---|---|---|---|
| 6,178,946 | B1 * | 1/2001 | Matthews | F01L 1/181 123/322 |
| 8,272,363 | B2 | 9/2012 | Meneely et al. | |
| 2010/0006062 | A1 * | 1/2010 | Yang | F01L 13/06 123/321 |
| 2010/0024767 | A1 * | 2/2010 | Meneely | F02D 13/04 123/323 |
| 2011/0120411 | A1 * | 5/2011 | Ren | F01L 1/26 123/321 |
| 2011/0220052 | A1 | 9/2011 | Sailer | |
| 2013/0206103 | A1 * | 8/2013 | Palumbo | F01L 13/065 123/323 |

* cited by examiner

SELF-CONTAINED COMPRESSION BRAKE CONTROL MODULE FOR COMPRESSION-RELEASE BRAKE SYSTEM OF AN INTERNAL COMBUSTION ENGINE

1. Field of the Invention

The present invention relates to compression-release brake systems for internal combustion engines in general, and, more particularly, to a self-contained compression-release brake control module for a compression-release engine brake system of an internal combustion engine.

2. Background of the Invention

For internal combustion engines (IC engine), especially diesel engines of large trucks, engine braking is an important feature for enhanced vehicle safety. Consequently, the diesel engines in vehicles, particularly large trucks, are commonly equipped with compression-release engine brake systems (or compression-release retarders) for retarding the engine (and thus, the vehicle as well). The compression release engine braking provides significant braking power in a braking mode of operation. For this reason, the compression-release engine brake systems have been in North America since the 1960's and gained widespread acceptance.

The typical compression-release engine brake system opens an exhaust valve(s) just prior to Top Dead Center (TDC) at the end of a compression stroke. This creates a blow-down of the compressed cylinder gas and the energy used for compression is not reclaimed. The result is engine braking, or retarding, power. A conventional compression-release engine brake system has substantial cost associated with the hardware required to open the exhaust valve(s) against the extremely high load of a compressed cylinder charge. Valve train components must be designed and manufactured to operate reliably at both high mechanical loading and engine speeds. Also, the sudden release of the highly compressed gas comes with a high level of noise. In some areas, typically urban, engine brake use is not permitted because the existing compression-release engine brake systems open the valves quickly at high compression pressure near the TDC compression that produces high engine valve train loads and a loud sound. It is the loud sound that has resulted in prohibition of engine compression release brake usage in certain urban areas.

Typically, the compression-release engine brake systems up to this time are unique, i.e., custom designed and engineered to a particular engine make and model. The design, prototype fabrication, bench testing, engine testing and field testing typically require twenty four (24) months to complete prior to sales release. Accordingly, both the development time and cost have been an area of concern.

Exhaust brake systems can be used on engines where compression release loading is too great for the valve train. The exhaust brake mechanism consists of a restrictor element mounted in the exhaust system. When this restrictor is closed, backpressure resists the exit of gases during the exhaust cycle and provides a braking function. This system provides less braking power than a compression release engine brake, but also at less cost. As with a compression release brake, the retarding power of an exhaust brake falls off sharply as engine speed decreases. This happens because the restriction is optimized to generate maximum allowable backpressure at rated engine speed. The restriction is simply insufficient to be effective at the lower engine speeds.

U.S. Pat. No. 8,272,363 describes a self-contained compression brake control module (CBCM) for controlling exhaust valve motion, primarily for, but not limited to, the purpose of engine retarding. The CBCM described in U.S. Pat. No. 8,272,363 is often required to operate with a significant axial offset between a longitudinal axis of the CBCM and a longitudinal valve axis of an exhaust valve it acts upon, as illustrated in FIGS. 2A-C of the U.S. Pat. No. 8,272,363.

The CBCM described in U.S. Pat. No. 8,272,363 comprises an actuation piston retaining ring and seal engaging the same bore within a single casing of the CBCM. This causes an increased diameter requirement in a portion of the bore due to assembly concerns with passing a seal past a retaining ring groove. The CBCM of U.S. Pat. No. 8,272,363 utilized a casing that contained the actuation piston while still requiring a support housing, adding diameter to the overall assembly. These contributors to a required offset generates a side force acting on the actuation piston of the CBCM, which causes a risk of wear and/or jamming of the actuation piston in its bore. Practical applications for the CBCM often dictate both a reduction in overall height and diameter in order to fit within existing engine packages without interference or undesired changes to other components. It is therefore advantageous to be able to reduce the size of the CBCM module, to both better center it over the loading generated by the exhaust valve, and to package it into tighter space constraints.

Thus, while known compression-release engine brake systems have proven to be acceptable for various vehicular driveline applications, such devices are nevertheless susceptible to improvements that may enhance their performance and cost. With this in mind, a need exists to develop improved compression-release engine brake systems that advance the art, such as a self-contained compression brake control module for a compression-release brake system of an internal combustion engine that is easier to assemble, is more robust and compact when assembled, enhances performance and significantly reduces the development time and cost of the compression-release engine brake system.

SUMMARY OF THE INVENTION

The present invention provides a compression-release brake system for an internal combustion including a more compact self-contained compression brake control module in the form of a hydraulically expandable linkage that is integrated with mounting hardware into the valve train of the I.C. engine. The compact design results in easier device assembly; and, a more robust and compact device when assembled.

The compression-release brake system comprises a self-contained compression brake control module (CBCM) operatively coupled to the exhaust valve for controlling a lift and a phase angle thereof. The CBCM includes a casing defining an actuator cavity, an actuation piston disposed outside the casing so as to define an actuation piston cavity between the casing, the actuation piston, and the bore into which the CBCM has been installed. The CBCM further includes a check valve provided between the actuation piston cavity and a compression brake actuator disposed in the actuator cavity. The actuation piston reciprocates relative to the casing and the bore. The compression brake actuator includes an actuator element and a biasing spring. The actuator element selectively engages the check valve when deactivated to unlock fluid contained within the actuation piston cavity and disengages from the check valve when activated so as to lock fluid within the actuation piston cavity.

The present invention provides advantages owing to its relatively smaller and more compact design. This design fits under valve train covers without major modification of existing fuel injection or valve train components and minimum increased valve cover height. In addition, the compact size enables design flexibility to install the CBCM even on engines configurations with a single valve cover per cylinder.

By virtue of the compact design and inclusion of an internal check valve, locking pressurized hydraulic fluid in a similarly compact actuation piston chamber, the present device provides a design using a minimum fluid volume thereby reducing the compliance of the trapped hydraulic fluid. The compactness thus yields a stiffer system to more readily maintain a constant exhaust valve(s) lift at higher engine loading in the CBCM engine braking mode. The compactness also creates the possibility of closer axial alignment between the CBCM and an underlying actuated exhaust valve.

The compact design can more easily be accommodated to more engine configurations and hardware with the same CBCM integrated hardware design and can be accomplished with much lower engineering design costs and time, prototype fabrication and validation testing.

BRIEF DESCRIPTION OF THE DRAWINGS

Additional objects and advantages of the invention will become apparent from a study of the following specification when viewed in light of the accompanying drawings, wherein.

DETAILED DESCRIPTION OF PREFERRED EMBODIMENTS

Figure 1A:
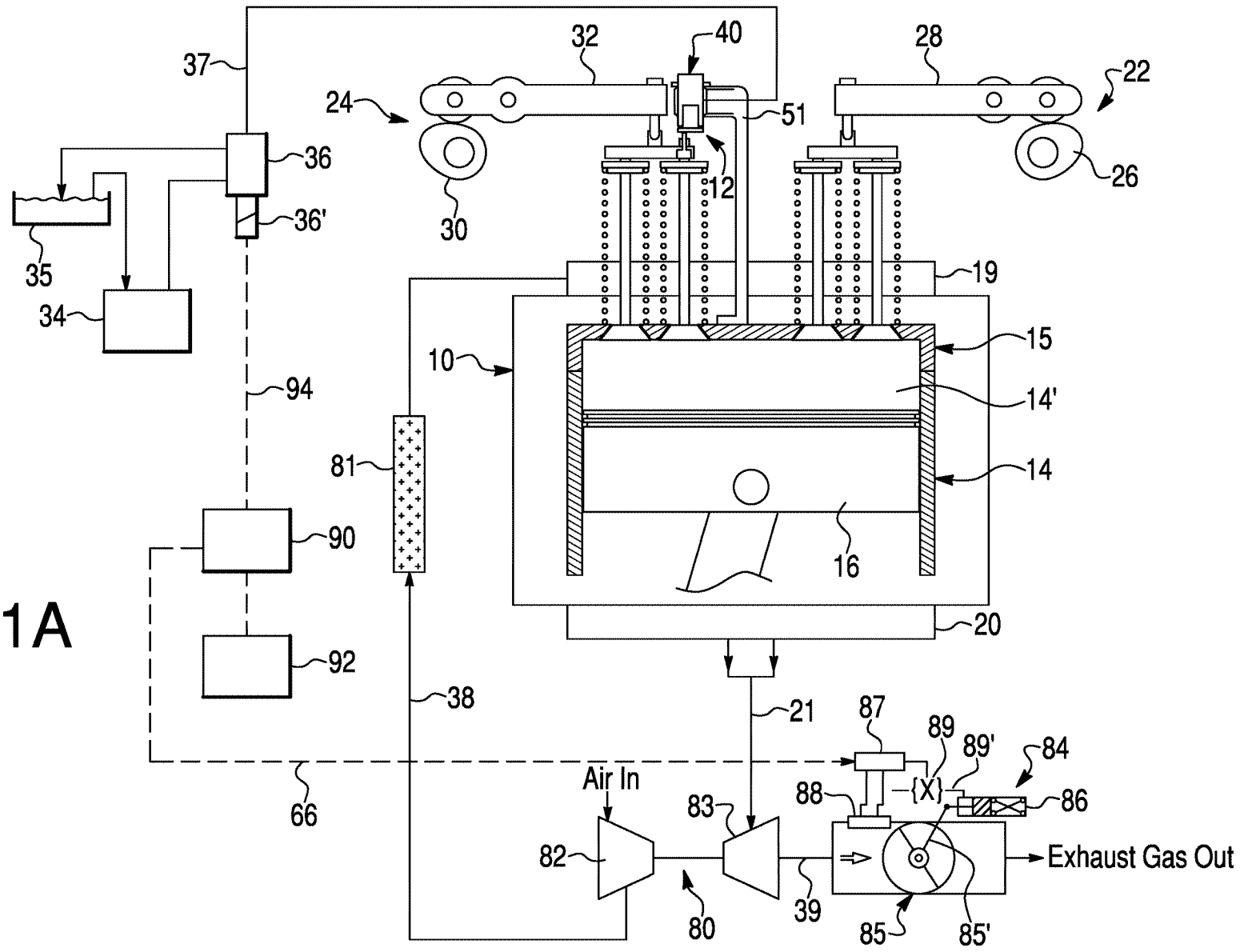
FIGS. 1A and 1B are schematic views of an internal combustion engine including a compression-release brake system according to an exemplary embodiment of the present invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiment(s) is intended to be read in connection with the accompanying drawings, which are to be considered part of the entire written description. In the description, relative terms such as "horizontal," "vertical," "up," "down," "upper", "lower", "right", "left", "top" and "bottom", "front" and "rear", "inwardly" and "outwardly" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. The term "integral" (or "unitary") relates to a part made as a single part, or a part made of separate components fixedly (i.e., non-moveably) connected together. The words "smaller" and "larger" refer to relative size of elements of the apparatus of the present invention and designated portions thereof. Additionally, the word "a" and "an" as used in the claims means "at least one" and the word "two" as used in the claims means "at least two".

Figure 1B:
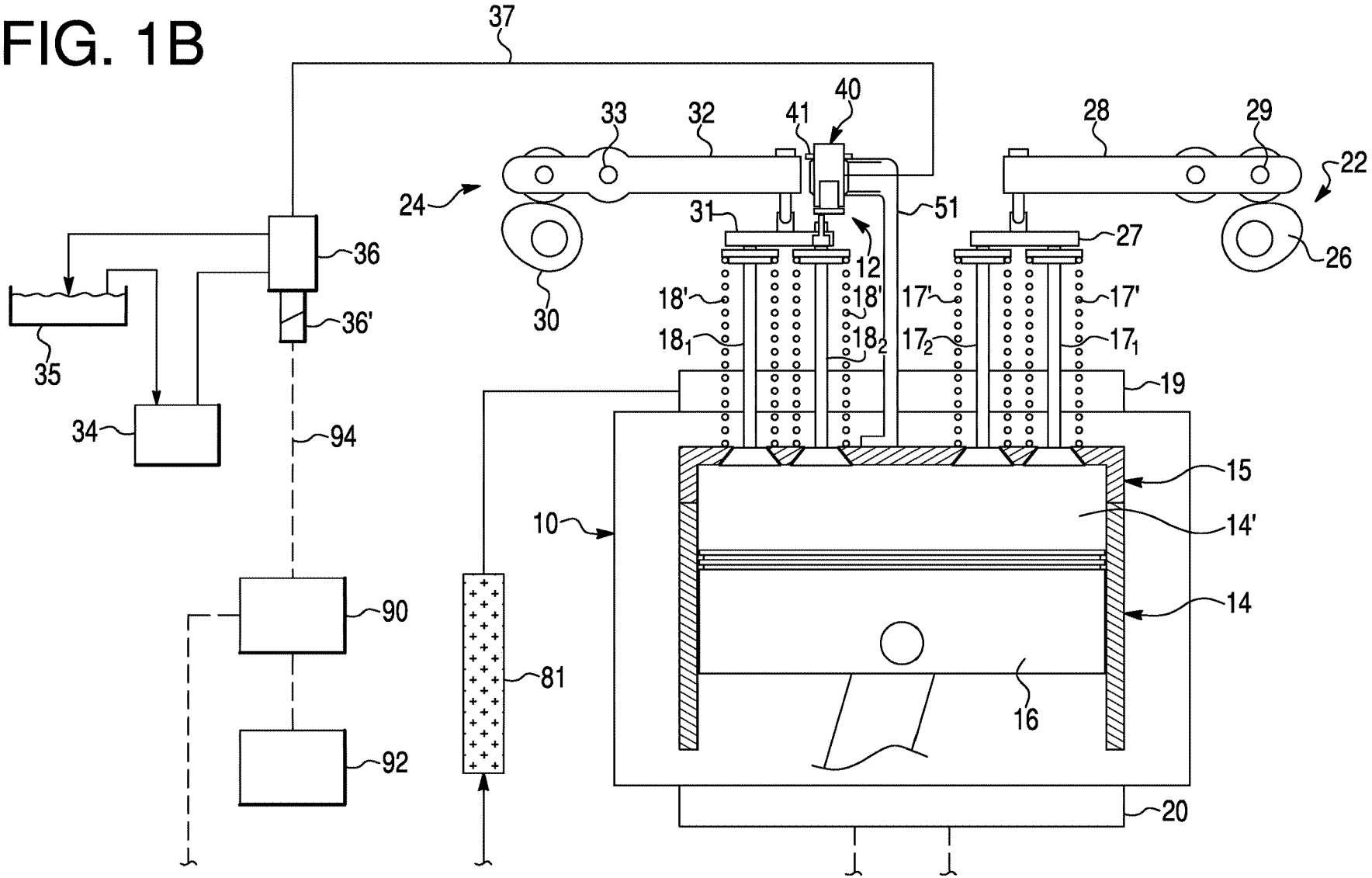

FIG. 1 schematically depicts a compression-release (or weeper) brake system 12 according to an exemplary embodiment of the present invention, provided for an internal combustion (IC) engine 10. Preferably, the IC engine 10 is a four-stroke diesel engine, comprising a cylinder block 14 including a plurality of cylinders 14'. However, for the sake of simplicity, only one cylinder 14' is shown in FIG. 1. Each cylinder 14' is provided with a piston 16 that reciprocates therein. Each cylinder 14' is further provided with two intake valves $\mathbf{17}_1$ and $\mathbf{17}_2$, and two exhaust valves $\mathbf{18}_1$ and $\mathbf{18}_2$, each provided with a return spring 17' or 18', respectively, and a valve train provided for lifting and closing of the intake and exhaust valves 17 and 18. The intake valves $\mathbf{17}_1$ and $\mathbf{17}_2$ as well as exhaust valves $\mathbf{18}_1$ and $\mathbf{18}_2$ are substantially structurally identical in this embodiment. In view of these similarities, and in the interest of simplicity, the following discussion will sometimes use a reference numeral without a letter to designate both substantially identical valves. For example, the reference numeral 17 will be sometimes used when generically referring to each of the intake valves $\mathbf{17}_1$ and $\mathbf{17}_2$, while the reference numeral 18 will be sometimes used when generically referring to each of the exhaust valves $\mathbf{18}_1$ and $\mathbf{18}_2$ rather than reciting all two reference numerals. It will be appreciated that each cylinder 14' may be provided with one or more intake valve(s) and/or exhaust valve(s), although two of each is shown in FIG. 1. The engine 10 also includes an intake manifold 19 and an exhaust manifold 20 both in fluid communication with the cylinder 14'. The IC engine 10 is capable of performing a positive power operation (normal engine cycle) and an engine brake operation (engine brake cycle). The compression-release brake system 12 operates in a compression brake mode (during the engine brake operation) and a compression brake deactivation mode (during the positive power operation).

The valve train of the present invention includes an intake rocker assembly 22 for operating the intake valves 17, and an exhaust rocker assembly 24 for operating the exhaust valves 18. The intake rocker assembly 22 includes an intake cam member 26, an intake rocker arm 28 mounted about an intake rocker shaft 29 and provided to open the intake valves 17 through an intake valve bridge 27. Similarly, the exhaust rocker assembly 24 includes an exhaust cam member 30, an exhaust rocker arm 32 mounted about an exhaust rocker shaft 33 and provided to open the exhaust valves 18 (i.e., the exhaust valves $\mathbf{18}_1$ and $\mathbf{18}_2$) through an exhaust valve bridge 31.

As further illustrated in FIG. 1, the compression-release brake system 12 according to the exemplary embodiment of the present invention comprises a self-contained compression brake control module (or CBCM) 40 for selectively controlling a lift and a phase angle of at least one of the exhaust valves 18. In the preferred embodiment of the present invention, the CBCM 40 is provided for controlling exhaust valve motion, primarily for, but not limited to, the purpose of engine retarding. Specifically, the CBCM 40 is provided primarily for selectively controlling a lift and a phase angle of at least one of the exhaust valves $\mathbf{18}_2$ which is capable to function as a brake exhaust valve. In other words, the CBCM 40 is provided for selectively controlling a valve lash of the brake exhaust valve $\mathbf{18}_2$. The compression brake control module 40 is a hydraulically expandable linkage that is integrated into the valve train of the I.C. engine 10. The compression brake control module 40 is an essential part of the compression-release brake system 12 that holds the brake exhaust valve $\mathbf{18}_2$ off the valve seat a preset amount for either the full engine cycle or a partial engine cycle. The compression-release brake system 12 can be combined with an exhaust brake to provide two-cycle braking. The compression brake control module 40 according to the exemplary embodiment of the present invention, is a universal compact mechanism that can be applied to different engine configurations with only slight modifications to mount the compression brake control module 40 to different engine valve train overheads. The CBCM 40 has a longitudinal axis $X_M$, as best shown in FIGS. 2A and 3A.

In the exemplary embodiment, illustrated in FIG. 1, the compression brake control module 40 is fixed (i.e., non-movably, attached to a stationary part of the engine) so as to be operatively disconnected from and spaced from the exhaust rocker assembly 24. Specifically, the compression brake control module 40 is disposed adjacent to the exhaust valves 18 and spaced from the exhaust rocker arm 32. More specifically, as illustrated in details in FIGS. 3A-3B and 4A-4B, the compression brake control module 40 comprises a hollow casing in the form of a cylindrical single-piece body 42 including a unitary, hollow cylindrical inner portion 53, which defines a cylindrical valve cavity 44. The cylindrical single-piece body 42 also defines a cylindrical actuator cavity 45 separated from the cylindrical valve cavity 44 by an inner (or separation) wall 46 and being in fluid communication with each other through a connecting passage 47 through the inner wall 46. As further illustrated in FIGS. 3A-3B and 4A-4B, a cylindrical outer peripheral surface 43 of the casing 42 is at least partially threaded so as to be threadedly received in an internally threaded bore of a support member 51 fixed to a cylinder head 15 (or the cylinder block 14) of the I.C. engine 10 (as shown in FIGS. 1 and 2A-2C). A lock nut 41 is provided to adjustably fasten and non-moveably retain the casing 42 of the CBCM 40 to the support member 51, i.e., to lock the casing 42 of the CBCM 40 in position relative to the support member 51. Thus, the casing 42 of the CBCM 40 is non-movably, i.e., fixedly, mounted to the I.C. engine 10.

The CBCM 40 further comprises an actuation piston 48 slidingly mounted to the casing 42 for slidingly reciprocating within a cylindrical bore 98 in the support member 51 (best shown in FIG. 2A) and relative to the casing 42 of the CBCM 40 between a collapsed position (shown in FIGS. 3A-3B) and an extended position (shown in FIGS. 4A-4B) so that the casing 42 and the actuation piston 48 define a variable volume hydraulic actuation piston chamber 50 within the actuation piston 48 between an inner end face 49*a* of the actuation piston 48 and the inner wall 46 of the casing 42. Moreover, a variable volume hydraulic actuation piston cavity 57 is defined within the cylindrical bore 98 of the support member 51 between the casing 42 and the actuation piston 48, as best shown in FIGS. 4A-4B. According to the exemplary embodiment of the present invention, a hydraulic seal 52 is utilized between the actuation piston 48 and the cylindrical bore 98 of the support member 51 to eliminate piston to bore leakage of the pressurized hydraulic fluid.

Figure 2A:
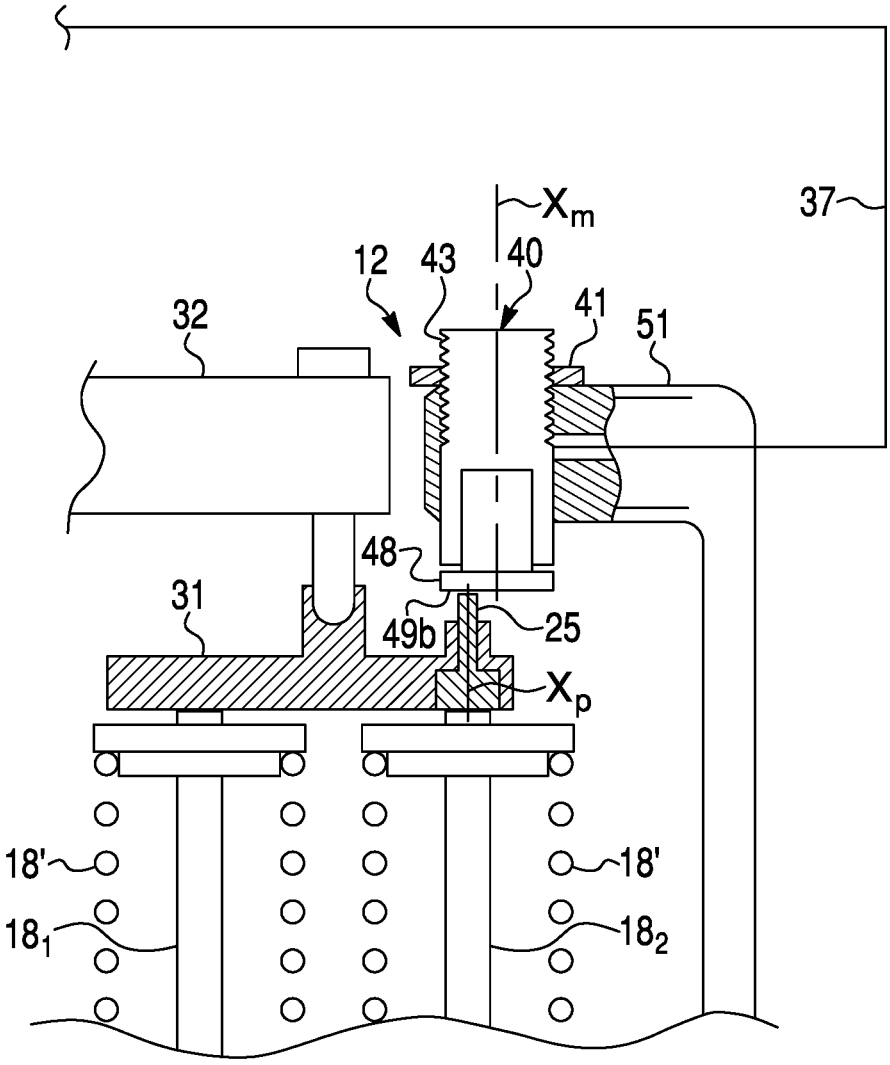
FIG. 2A is an enlarged schematic view of the portion of the compression-release brake system according to the exemplary embodiment of the present invention with exhaust valves closed.
Figure 3A:
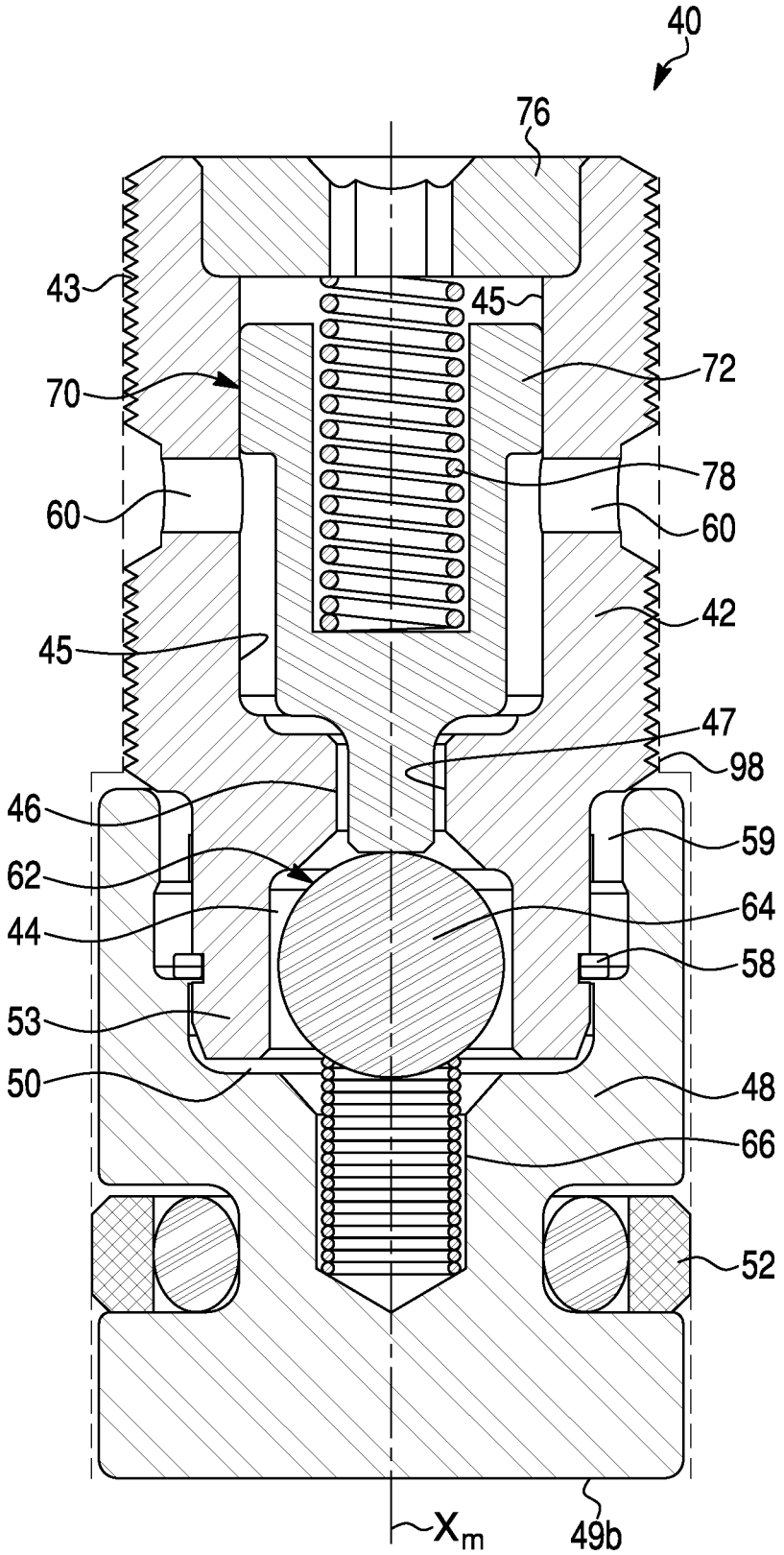
FIGS. 3A and 3B are sectional views of a hydraulically actuated compression brake control module of the compression-release brake system according to the exemplary embodiment of the present invention in a depressurized condition.
Figure 3B:
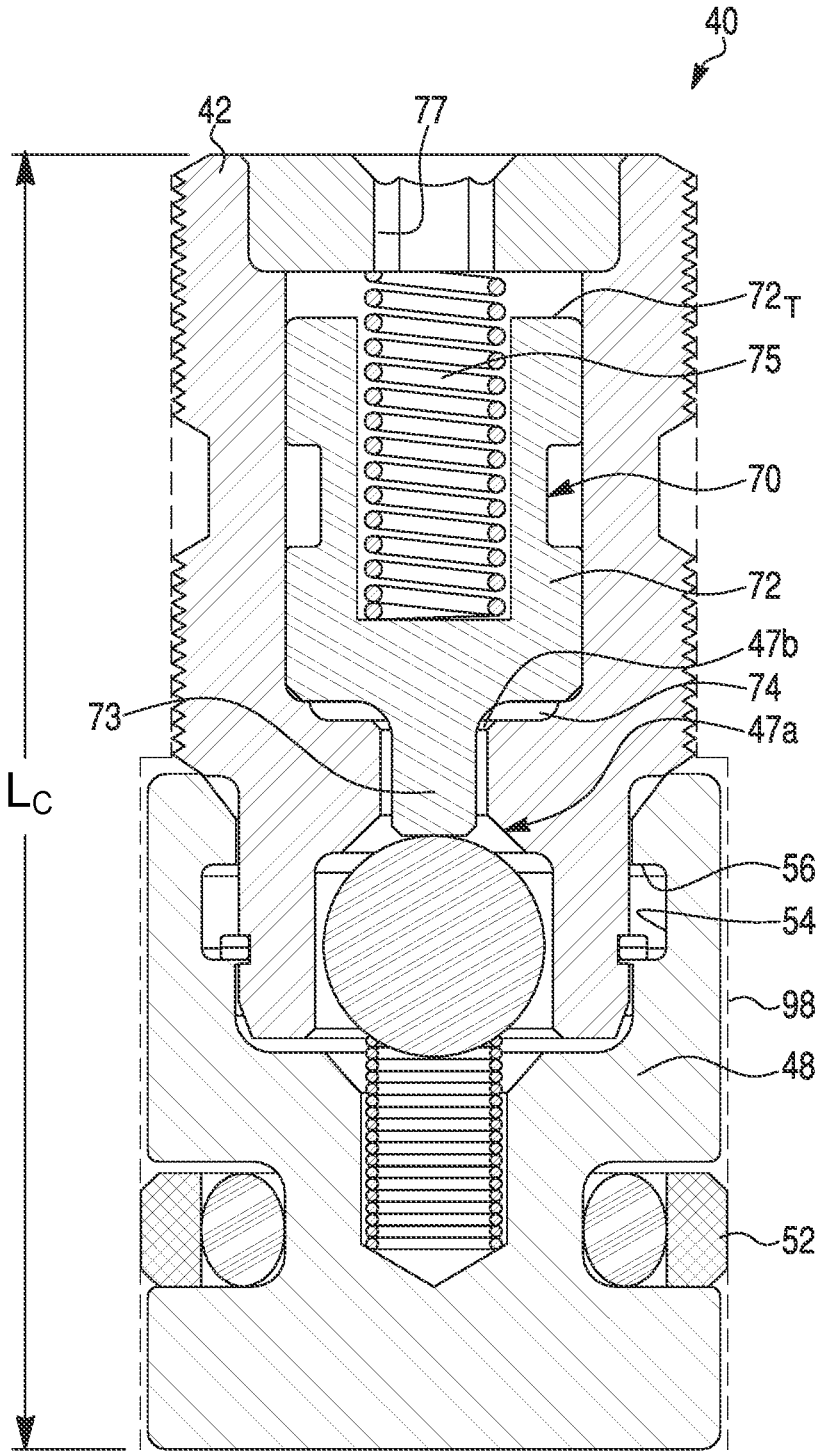
Figure 4A:
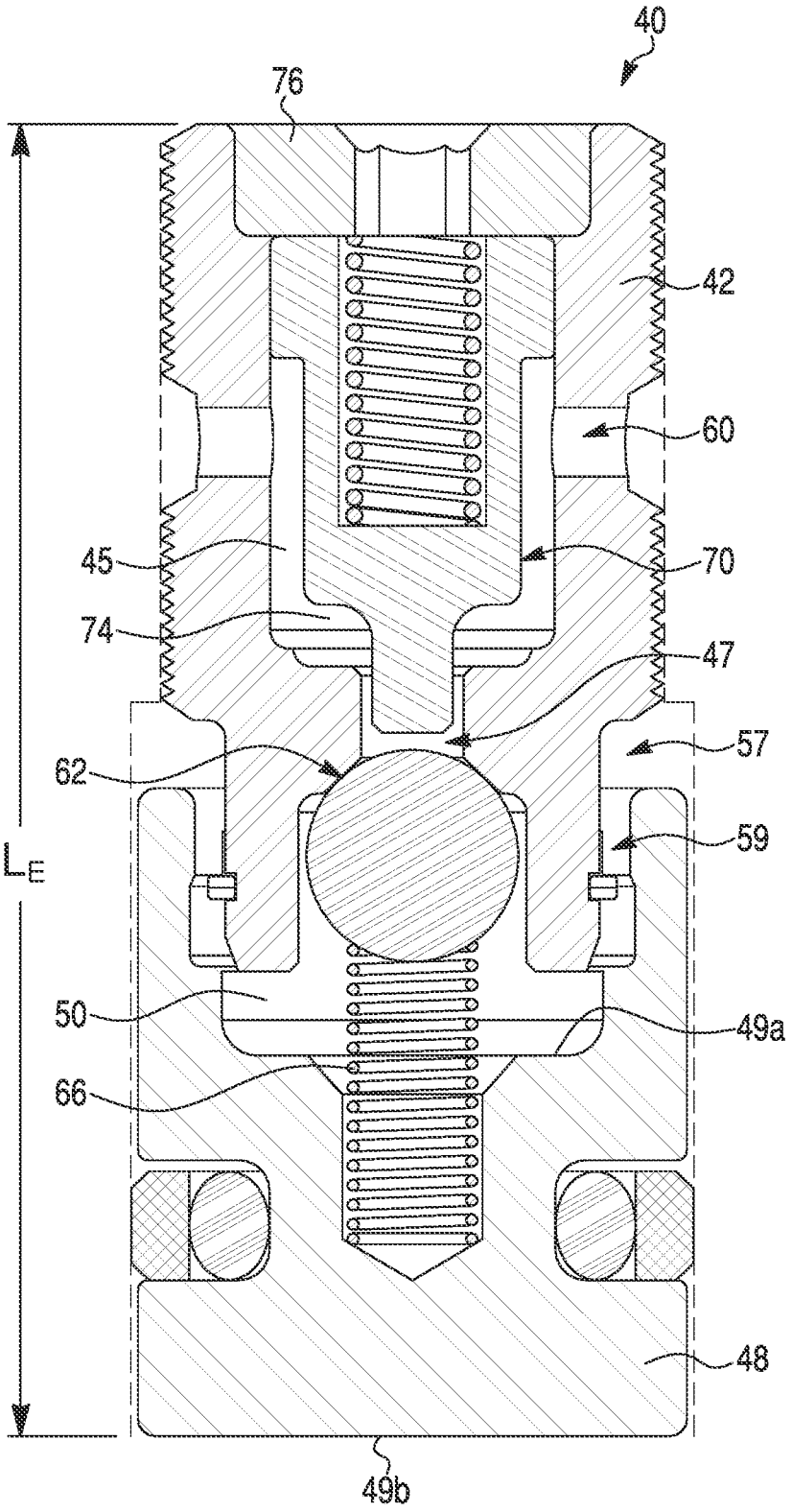
FIGS. 4A and 4B are sectional views of the hydraulically actuated compression brake control module of the compression-release brake system according to the exemplary embodiment of the present invention in a pressurized condition.
Figure 4B:
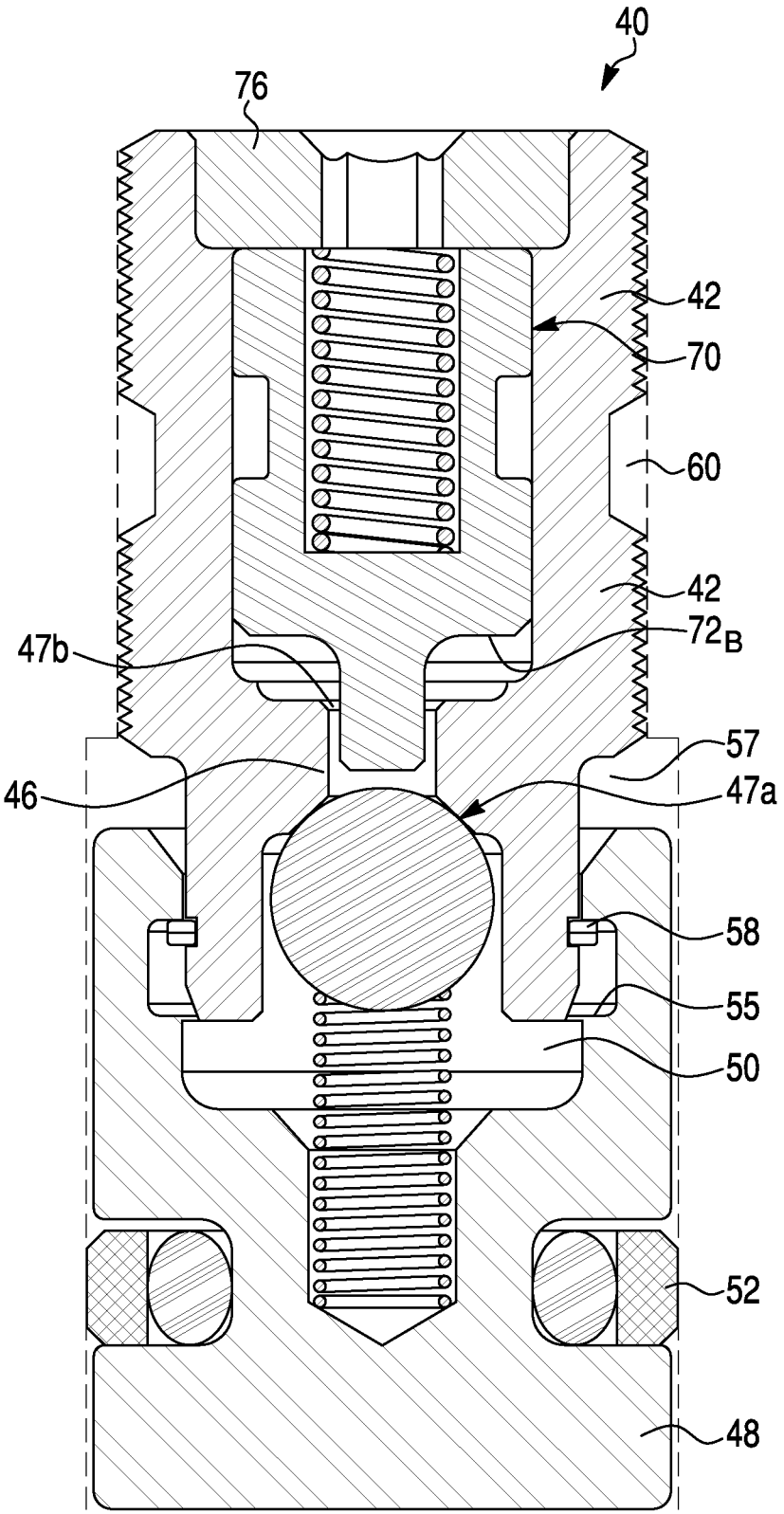

The actuation piston 48 is coaxial with the longitudinal axis $X_M$ of the CBCM 40, as best shown in FIGS. 2A and 3A. An outer end face 49*b* of the actuation piston 48 is provided to engage the brake exhaust valve $\mathbf{18}_2$ in the extended position thereof through an exhaust valve pin 25 reciprocatingly mounted to the exhaust valve bridge 31. In other words, the exhaust valve pin 25 is reciprocatingly movable relative to the exhaust valve bridge 31 so as to make the brake exhaust valve $\mathbf{18}_2$ movable relative to the exhaust valve $\mathbf{18}_1$ and the exhaust valve bridge 31. Moreover, as best shown in FIG. 2A, the longitudinal axis $X_M$ of the CBCM 40 is offset relative to a longitudinal pin axis $X_P$ of the exhaust valve pin 25, which, in turn, is coaxial with the brake exhaust valve $\mathbf{18}_2$.

The actuation piston 48 has an annular retaining ring 58 disposed in a complementary groove in an annular outer peripheral surface of the cylindrical inner portion 53 of the casing 42 of the CBCM 40. The groove is sufficiently shallow such that a portion of the retaining ring 58 projects radially outwardly from the cylindrical inner portion 53 of the casing 42. Moreover, a cylindrical inner surface 53 of the casing 42 is formed with an annular piston groove 54 having annular flat, axially opposite outer and inner stop surfaces 55 and 56, respectively.

As shown in FIGS. 3A-4B, the retaining ring 58 extends into the piston groove 54 between the outer and inner stop surfaces 55 and 56 thereof provided to mechanically limit upward and downward movements of the actuation piston 48. As illustrated in FIGS. 3A-4B, the width of the piston groove 54 is substantially larger than the width of the retaining ring 58 so as to allow the actuation piston 48 to reciprocate relative to the casing 42 between the outer and inner stop surfaces 55 and 56 of the piston groove 54. Thus, the retaining ring 58 limits axial movement of the actuation piston 48 along the longitudinal axis $X_M$ between the collapsed position (shown in FIGS. 3A-3B) and the extended position (shown in FIGS. 4A-4B) thereof. As a result, the actuation piston 48 can reciprocate relative to the casing 42 of the CBCM 40 and over the cylindrical inner portion 53 of the casing 42 between two mechanical actuation piston stops defining the extended position (shown in FIGS. 4A, 4B) and the collapsed position (shown in FIGS. 3A, 3B). In other words, the actuation piston 48 can extend outwardly from the casing 42 of the CBCM 40 until the inner stop surface 56 of the piston groove 54 contacts the retaining ring 58, as illustrated in FIGS. 4A and 4B, which is defined as the extended position. Similarly, the actuation piston 48 can retract inwardly toward the casing 42 of the CBCM 40 until the outer stop surface 55 of the piston groove 54 contacts the retaining ring 58, as illustrated in FIGS. 3A and 3B, which is defined as the collapsed position. Thus, the piston groove 54 functions as a stroke limiting slot. A length of the CBCM 40 in the extended position (illustrated in FIG. 4A) is $L_E$, while the length of the CBCM 40 in the collapsed position (illustrated in FIG. 3B) is $L_C$ which is smaller than the length $L_E$.

The hydraulic seal 52 mounted to an outer peripheral surface of the actuation piston 48 and the retaining ring 58 disposed within the actuation piston 48 provides a decrease in overall CBCM diameter, thereby allowing for a reduction in offset distance between the longitudinal axis of the CBCM 40 and the longitudinal valve axis of the brake exhaust valve $18_2$.

Figure 2B:
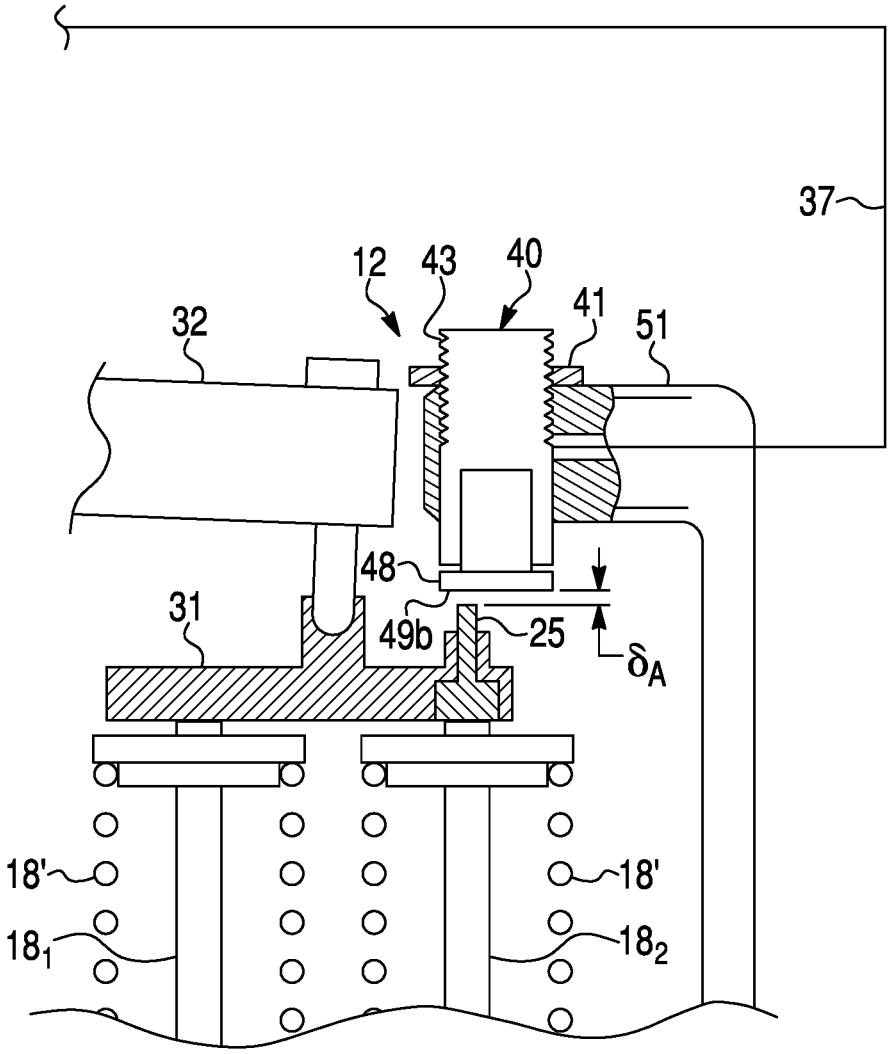
FIG. 2B is an enlarged schematic view of the portion of the compression-release brake system according to the exemplary embodiment of the present invention with exhaust valves open by an exhaust rocker assembly.
Figure 2C:
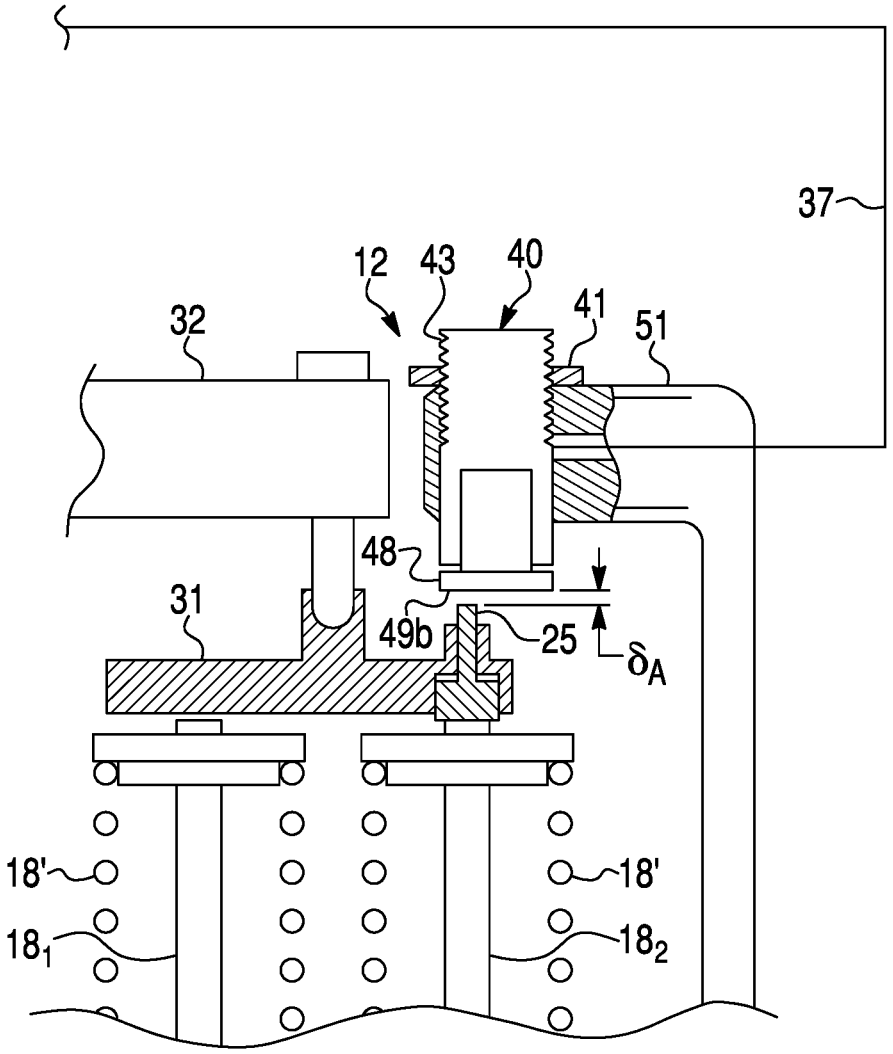
FIG. 2C is an enlarged schematic view of the portion of the compression-release brake system according to the exemplary embodiment of the present invention with the exhaust valves floating due to backpressure in an exhaust manifold.

The compression brake control module 40 further comprises a supply (or inlet) port 60 formed within the body of the casing 42. This provides a pressurized hydraulic fluid from a source 34 of the pressurized hydraulic fluid to the hydraulic actuation piston chamber 50 through the connecting passage 47. This pressure extends the actuation piston 48 to the extended position thereof when there is a gap 6A between the actuation piston 48 and the exhaust valve pin 25 of the brake exhaust valve $18_2$. This gap can occur such as when the exhaust valves 18 are open by the exhaust rocker assembly 24 (as illustrated in FIG. 2B) or when the exhaust valves 18 float due to backpressure in the exhaust manifold 20 acting to back faces of the exhaust valves 18 (as illustrated in FIG. 2C). Preferably, the source 34 of the pressurized hydraulic fluid is in the form of an engine oil pump (not shown) of the diesel engine 10. Correspondingly, in this exemplary embodiment, an engine lubricating oil is used as the working hydraulic fluid stored in a hydraulic fluid sump 35. It will be appreciated that any other appropriate source of the pressurized hydraulic fluid and any other appropriate type of fluid will be within the scope of the present invention.

Thus, the hydraulically activated compression brake control module 40 of the compression-release brake system 12 holds the exhaust valve 18 off the exhaust valve seat at a predetermined setting, i.e., timing and duration, for the compression brake actuation mode of the I.C. engine 10.

The compression-release brake system 12 according to the exemplary embodiment of the present invention further includes an external compression brake control valve 36 (shown in FIG. 1) provided to selectively fluidly connect the source 34 of the pressurized hydraulic fluid to the compression brake control module 40 through a compression brake fluid passageway 37. In other words, the compression brake control valve 36 is provided to selectively supply the pressurized hydraulic fluid from the source 34 to the CBCM 40 so as to switch the CBCM 40 between an activated (pressurized) condition (or energized state) (shown in FIGS. 4A and 4B) when the pressurized hydraulic fluid is supplied to the CBCM 40 and a deactivated (depressurized) condition (or de-energized state) (shown in FIGS. 3A and 3B) when the pressurized hydraulic fluid is not supplied to the CBCM 40. It should be understood that the compression brake fluid passageway 37 communicates with (is fluidly connected to) the supply port 60 of the CBCM 40. Preferably, the compression brake control valve 36 is an external three-way solenoid valve activated by an electromagnet (solenoid) 36' supplying the pressurized engine oil to the CBCM 40 during the compression brake actuation mode. To deactivate the compression-release brake system 12, the external three-way solenoid 36 dumps the engine oil supply back to the hydraulic fluid sump 35. As further illustrated in FIG. 1, the compression brake control valve 36 is fixed to a cylinder head 15 or cylinder block 14 of the I.C. engine 10. Thus, the compression brake control valve 36 of the compression-release brake system 12 is non-movably mounted to the I.C. engine 10.

The connecting passage 47 formed longitudinally through the separation wall 46, includes a piston opening 47*a*, and an actuator opening 47*b*. As illustrated in detail in FIGS. 3A-4B, the hydraulic actuation piston chamber 50 fluidly communicates with the connecting passage 47 in the inner wall 46 through the piston port 47*a*, the actuator cavity 45 fluidly communicates with the connecting passage 47 through the actuator port 47*b*, and the supply port 60 fluidly communicates with the connecting passage 47 also through the actuator port 47*b*. In other words, the connecting passage 47 provides fluid communication between the actuation piston chamber 50 and the actuator cavity 45 of the CBCM 40 and the supply port 60 within the body 42 of the CBCM 40, thus between the actuation piston chamber 50 and the actuator cavity 45 and the source 34 of the pressurized hydraulic fluid.

The CBCM 40 further comprises a check valve 62 provided in the valve cavity 44 of the cylindrical inner portion 53 of the casing 42 between the supply port 60 and the actuation piston chamber 50 to hydraulically lock the actuation piston chamber 50 when a pressure of the hydraulic fluid within the actuation piston chamber 50 exceeds the pressure of the hydraulic fluid from the source 34 during the compression brake actuation mode. In other words, the check valve 62 is disposed in the actuation piston chamber 50 (i.e., between the inner end face 49*a* of the actuation piston 48 and the separation wall 46 of the casing 42) to selectively isolate and seal the actuation piston chamber 50. Preferably, the check valve 62 includes a valve member, preferably in the form of a substantially spherical ball member 64 provided to seal against the piston port 47*a* of the connecting passage 47. It should be understood that an edge of the separation wall 46 forming the piston port 47*a* defines a valve seat of the ball member 64 of the check valve 62. Preferably, the ball member 64 is biased against the piston opening 47*a* of the connecting passage 47 by a biasing coil spring 66. The hydraulically activated CBCM 40 provides a seal to eliminate oil leakage from the high-pressure actuation piston chamber 50 and hold the actuation piston 48 in the retracted position without an additional return spring.

The CBCM 40 also comprises a hydraulic compression brake actuator 70 mounted within the actuator cavity 45 of the casing 42. Actuator 70 selectively engages the ball member 64 of the check valve 62 when the CBCM is deactivated so as to unlock the actuation piston chamber 50 and fluidly connect the actuation piston chamber 50 to the source 34 of the pressurized hydraulic fluid. When activated, actuator 70 disengages the ball member 64 of the check valve 62 so as to lock the actuation piston chamber 50 and fluidly disconnect the actuation piston chamber 50 from the source 34 of the pressurized hydraulic fluid. The compression brake actuator 70 includes a reciprocating actuator element (or control piston) 72 slidingly mounted within the casing 42 for reciprocating within the actuator cavity 45 between a retracted position (shown in FIGS. 3A and 3B) and an extended position (shown in FIGS. 4A and 4B). The casing 42 and the control piston 72 define a variable volume actuator chamber 74 within an innermost portion of the cylindrical actuator cavity 45 between an inner end (or bottom) face $72_B$ of the control piston 72 and the separation wall 46 of the casing 42. An outer end (or top) face $72_T$ of the control piston 72 is provided to engage an end cap 76 of the casing 42 in the extended position thereof. The compression brake actuator 70 also includes a control piston spring 78 acting between the control piston 72 and the end cap 76 to bias the control piston 72 downwardly toward the retracted position thereof. The control piston 72 is bored so as to form a vent chamber 75 between the control piston 72 and the end cap 76 to receive the control piston spring 78. The vent chamber 75 formed between the end cap 76 and the control piston 72 is subject to atmospheric pressure through a vent port 77 provided in the end cap 76 so as to expose the outer end (or top) face $72_T$ of the control piston 72 to atmospheric pressure. The control piston 72 is adapted to reciprocate between the separation wall 46 of the casing 42 and the end cap 76. As illustrated in FIGS. 3A-4B, the control piston 72 is formed integrally with a protrusion 73 extending into the connecting passage 47 in the separation wall 46 toward the valve member 64 of the check valve 62.

Thus, the compression brake control module 40 incorporates a system to trap engine hydraulic oil in a actuation piston chamber 50 above the actuation piston 48 to prevent the exhaust valve 18 from returning to the valve seat at the end of the compression stroke. The system assures an absolute minimum trapped oil volume to minimize the bulk modulus compressibility of the trapped oil in the actuation piston chamber 50. The CBCM 40 is attached to the engine 10 (preferably to a cylinder head) through an attaching hardware that incorporates a stiff mounting hold-down to minimize mechanical hardware flexibility during engine braking operation. Incorporation of minimum oil compliance and hardware deflections provides predictable and optimal engine brake retarding performance. The present invention thus provides a miniaturized CBCM 40 housing package.

The compression-release brake system 12 of the I.C. engine 10 can be used in conjunction with a fixed orifice exhaust brake, a pressure regulated exhaust brake or a variable geometry turbocharger (VGT) to incorporate two cycle engine braking. The combination uses the compression and exhaust strokes to produce a quieter system with reduced engine valve train loading while yielding excellent brake retarding power. Thus, the diesel engine 10 further comprises a turbocharger 80 including a compressor 82 and a turbine 83, and a variable exhaust brake 84 fluidly connected to the turbocharger 80 through an exhaust passage 21. As illustrated in FIG. 1, the compressor 82 is in fluid communication with the intake manifold 19 through an intake conduit 38, while the turbine 83 is in fluid communication with the exhaust manifold 20 through an exhaust conduit 39. Conventionally, the exhaust gases from the exhaust manifold 20 rotate the turbine 83 and exit the turbocharger 80 through the exhaust conduit 39 into the exhaust brake 84. In turn, ambient air compressed by the compressor 82 is carried by the intake conduit 38 to the intake manifold 19 through an intercooler 81 where the compressed charge air is cooled before entering the intake manifold 19. The charge air enters the cylinder 14 through the intake valve 17 during an intake stroke. During an exhaust stroke, the exhaust gas exits the cylinder 14 through the exhaust valve 18, enters into the exhaust manifold 20 and continues out through the turbine 83 of the turbocharger 80.

As illustrated in FIG. 1, the exhaust brake 84 of the exemplary embodiment of the present invention is located downstream of the turbocharger 80. However, the location of the exhaust brake 84 is not limited to being downstream of the turbine 83 or to the form of a conventional exhaust brake. Alternatively, the exhaust brake 84 may be placed upstream of the turbocharger 80 (the turbine 83). Where the exhaust brake 84 is installed upstream of the turbocharger 80, advantage is taken by generating a high-pressure differential across the turbine 83. This drives the turbocharger compressor 82 to a higher speed and thereby provides more intake boost to charge the cylinder for engine braking.

In accordance with the present invention illustrated in FIG. 1, the exhaust brake 84 includes a variable exhaust restrictor in the form of a butterfly valve 85 operated by an exhaust brake actuator 86. Preferably, the butterfly valve 85 is rotated by linkage 85' connected to the exhaust brake actuator 86 in order to adjust the exhaust restriction, thus the amount of exhaust braking. The exhaust brake actuator 86 of the present invention may be of any appropriate type known to those skilled in the art, such as a fluid actuator (pneumatic or hydraulic), an electromagnetic actuator (e.g. solenoid), an electromechanical actuator, etc. Preferably, in this particular example, the exhaust brake actuator 86 is a pneumatic actuator, although, as noted above, other actuating devices could be substituted.

The exhaust brake actuator 86 is controlled by a microprocessor (or exhaust brake electronic controller) 87. The microprocessor 87 controls the variable exhaust restrictor 85, thus the amount of exhaust braking, based on the information from a plurality of sensors 88 including, but not limited, an pressure sensor and a temperature sensor sensing pressure and temperature of the exhaust gas flowing through the exhaust restrictor 85 of the exhaust brake 84. It will be appreciated by those skilled in the art that any other appropriate sensors, may be employed. The pneumatic actuator 86 is operated by a solenoid valve 89 provided to selectively connect and disconnect the pneumatic actuator 86 with a pneumatic pressure source (not shown) through a pneumatic conduit 89' in response from a control signal from the microprocessor 87.

The compression-release brake system 12 according to the exemplary embodiment of the present invention is controlled by an electronic controller 90 (as illustrated in FIG. 1), which may be in the form of a CPU or a computer. The electronic controller 90 operates the electromagnetic compression brake control valve 36 based on the information from a plurality of sensors 92 representing engine and vehicle operating parameters as control inputs, including, but not limited to, an engine speed, an engine load, an engine operating mode, etc. It will be appreciated by those skilled in the art that any other appropriate sensors, may be employed. The electronic controller 90 is programmed to provide a signal 94 to the solenoid 36 of the external three-way control valve 36 to cause them to selectively and independently open or close based on operating demand of the engine 10. When the compression brake control valve 36 is open, pressurized hydraulic fluid, such as pressurized engine oil, is provided to the hydraulic compression brake actuator 70 of the compression brake control module 40 and the I.C. engine 10 operates in the compression brake mode (engine brake cycle). Correspondingly, when the solenoid compression brake control valve 36 is closed, no pressurized hydraulic fluid is supplied to the hydraulic compression brake actuator 70 of the compression brake control module 40 and the I.C. engine 10 operates in the normal engine cycle.

The exhaust brake 84 reads exhaust system pressure and temperature from the sensors 92 at the microprocessor 90 and regulates a signal 89 to the exhaust brake actuator 86 that adjusts the variable exhaust restrictor 85. The electronic controller 90 also provides a signal 96 to the microprocessor 87 of the exhaust brake 84. When the engine 10 is operating in engine brake mode, the control signal 96 adjusts the variable exhaust restrictor 85 in order to maintain a desired exhaust backpressure.

The braking operation of the I.C. engine 10 of the present invention has two integral components: a compression release (weeper) braking provided by the compression-release brake system 12, and an exhaust braking provided by the exhaust brake 84. The compression release braking component is provided by action of the compression brake control module 40 of the compression-release brake system 12, while the exhaust braking is provided by the exhaust brake 84.

The operation of the compression-release brake system 12 is described in detail below.

When the engine 10 performs positive power operation (i.e., operates in the normal engine cycle), the solenoid 36' closes the compression brake control valve 36 and the hydraulic compression brake control module 40 is in the depressurized condition (or de-energized state) so that no hydraulic fluid is supplied to the compression brake control module 40, and the actuation piston chamber 50 and the actuation piston cavity 57 are filled with hydraulic fluid but not the pressurized hydraulic fluid. In such a condition, shown in FIGS. 3A and 3B, the control piston 72 is moved to and supported in the retracted position thereof (only by the biasing force of the control piston spring 78). In other words, the control piston spring 78 maintains the control piston 72 in this position, which upsets the ball member 64 from the valve seat 47*a* in the casing 42. Specifically, in this position, the protrusion 73 of the control piston 72 displaces the ball member 64 of the check valve 62 away from the valve seat thereof by overcoming the biasing force of the spring 66 of the check valve 62, which is lighter than the biasing force of the control piston spring 78 of the compression brake actuator 70. Thus, the hydraulic fluid is able to flow within the CBCM 40 without causing it to energize, provided that it is not able to reach a pressure high enough to extend the control piston 72 against the control piston spring 78 and allow the ball member 64 to reach the valve seat 47*a*.

The actuation piston 48 is able to extend if the friction of the hydraulic seal 52 is overcome, but will then retract under load in this state. The de-energized state is utilized during the normal engine operation. The actuation piston 48 is set with an initial spacing (lash) to an exhaust valve or exhaust valve bridge (shown in FIG. 2A). The friction of the hydraulic seal 52 is typically enough to maintain this lash. In the case that the friction of the hydraulic seal is insufficient an activation piston return spring can be added to avoid 'clatter' of the actuation piston 48 as it extends and is pushed back in during normal exhaust valve motion.

During the engine braking operation, when it is determined by the electronic controller 90 based on the information from the plurality of sensors 92 that the braking is demanded, such as when a throttle valve (not shown) of the engine 10 is closed, the exhaust brake 84 is actuated by at least partially closing the butterfly valve 85 in order to create a backpressure resisting the exit of the exhaust gas during the exhaust stroke. Moreover, during the engine braking operation, the electronic controller 90 opens the compression brake control valve 36 to turn on the supply of the pressurized hydraulic fluid to the compression brake control module 40, thus setting the compression brake control module 40 to the pressurized condition.

Pressurized hydraulic fluid enters the CBCM 40 from the support member 51 through the inlet port 60 and passes through machined facets (or ribs) of the control piston 72 of the compression brake actuator 70 to the connecting passage 47. Consequently, the pressurized hydraulic fluid fills the actuation piston cavity 57, building pressure in the CBCM 40, which extends the actuation piston 48 and the control piston 72 until they contact the retaining ring 58 and the end cap 76, respectively. Moreover, when the pressurized engine oil is supplied to the inlet port 60 of the compression brake control module 40, the control piston 72 of the compression brake actuator 70 is forced outward by the supply oil pressure allowing the ball member 64 to be seated. The ball member 64 lands on the valve seat 47*a* of the casing 42, creating the one-way (i.e., check) valve 62 which traps hydraulic fluid in the actuation piston cavity 57. The energized state is utilized during the engine braking operation.

At the same time, the pressurized hydraulic fluid will flow into the actuation piston chamber 50 and the actuation piston cavity 57. As the pressurized supply oil fills the actuation piston chamber 50 and the actuation piston cavity 57, the pressure of the supply oil forces the actuation piston 48 outwardly until the actuation piston 48 contacts the mechanical stop (in the form of the retaining ring 58), as shown in FIGS. 4A and 4B, when the exhaust valves 18 are off the valve seat during the normal exhaust valve lift. The spring-loaded ball member 64 will lock the oil above the actuation piston 48 and prevent the actuation piston 48 from returning to the collapsed position thereof (shown in FIGS. 4A and 4B). This provides extended lift and phase angle for the brake exhaust valve $\mathbf{18}_2$. The extended open duration lift of the brake exhaust valve $\mathbf{18}_2$ forms a bleeder (weeper) opening during the engine compression stroke, and the engine 10 performs non-recoverable work as gas is forced out of the cylinder through this opening, which embodies the compression-release brake.

In a position illustrated in FIGS. 4A and 4B, the actuation piston 48 is locked in place by the trapped oil in the actuation piston chamber 50 and the actuation piston cavity 57, and stops one of the exhaust valves 18 from returning to the valve seat. The location of the actuation piston retaining ring 58, the stroke limiting slot 54 and the install position of the compression brake control module 40, determines the amount of distance that the exhaust valve 18 will be held off the valve seat, resulting in a predetermined lift during the complete engine braking cycle. The oil in the actuation piston chamber 50 is hydraulically locked by the ball check valve 62 located above the actuation piston 48 to hold the actuation piston 48 in the extended position.

Thus, when the exhaust cam member 30 moves the exhaust valve 18 away during the normal exhaust motion, the actuation piston 48 extends and 'catches' the exhaust valve 18 upon its return, in order to hold it open a fixed amount during the remainder of the engine cycle. There is a constant load on the actuation piston 48 from the exhaust valve return spring force, and a varying load due to pneumatic pressure in the engine cylinder acting on a face of the exhaust valve 18. Hydraulic pressure builds within the trapped oil in the actuation piston cavity 57 to support this load.

When the engine braking mode is deactivated, the solenoid valve 36 is turned off to cut the pressurized oil supply to the compression brake control module 40, thereby resulting in the control piston spring 78 forcing the control piston 72 toward the ball check valve 62, which unseats the ball member 64 from its seated position. The released oil flows out the actuation piston chamber 50 through the external three-way solenoid valve 36 and back to an oil sump 35, shown in FIG. 1. The actuation piston 48 is then forced back to the collapsed position (shown in FIG. 3) in the valve cavity 44 of the casing 42 by the force of the exhaust valve springs 18'. The exhaust valve 18 returns to the valve seat to allow for normal engine valve motion.

In other words, when hydraulic fluid pressure is removed from the CBCM 40, the control piston 72 moves back into contact with the ball member 64 until a subsequent normal exhaust valve event, at which point the hydraulic pressure in the actuation piston cavity 57 is reduced sufficiently for the force of the control piston spring 78 to unseat the ball member 64. The actuation piston 48 is provided with a hydraulic bypass feature (or passage) 59 to prevent the retaining ring 58 from trapping hydraulic fluid within the actuation piston cavity 57 when the CBCM 40 is de-energized.

The compression-release brake system 12 with the hydraulically activated compression brake control module 40 holds the exhaust valve 18 off the exhaust valve seat at a predetermined setting for the complete engine brake cycle (weeper brake event). The compression-release brake system 12 can be used in conjunction with a fixed orifice exhaust brake, a pressure regulated exhaust brake or a VGT turbocharger to incorporate two cycle engine braking. The combination uses the compression and exhaust strokes to produce a quieter system with reduced engine valve train loading while yielding excellent brake retarding power.

The compression-release brake system 12 used in combination with the pressure regulated exhaust brake 84 provides advantages over using a compression-release brake system with a fixed orifice exhaust brake. When a compression-release brake and exhaust brake combination is designed for maximum exhaust backpressure and the compression-release brake component fails to function for any reason the typical extended exhaust/intake valve overlap condition will be eliminated. The elimination of the extended valve overlap results in much higher exhaust manifold pressures and the engine can experience unacceptable valve seating velocities which can result in major engine damage and excessive valve seat wear.

Major engine damage can result from valve seat damage or valve spring failure. Valve spring failure can cause engine valves to drop into the combustion chamber and can cause progressive engine damage. Valve seat damage can progress because the exhaust valve will not adequately seal compression pressures and/or not provide good heat transfer from the exhaust valve to the cylinder head during high positive power engine loading.

The pressure regulated exhaust brake that is used in combination with the compression-release brake system has the advantage that the exhaust brake can be used alone on a combination compression-release/exhaust brake engine with no possibility of over-pressurizing the exhaust manifold and thereby avoiding excessive valve floating and unacceptable valve seating velocities. Because the pressure regulated exhaust brake is self-regulating, over-pressurization of the exhaust manifold cannot occur because the restriction orifice in the exhaust brake increases in area automatically to maintain a highest constant exhaust manifold pressure in compliance with engine manufacture specifications.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A compression brake control module, in a compression-release brake system for operating at least one exhaust valve of an internal combustion engine during a compression-release engine braking operation, the compression brake control module operatively coupled to the at least one exhaust valve for controlling a lift and a phase angle of said at least one exhaust valve, so as to maintain the at least one exhaust valve open during a compression stroke of the engine when the engine performs a compression-release engine braking operation, the compression brake control module comprising:

a casing including a single-piece body, adapted for mounting within and fixedly engaging a bore within said engine, said casing including an internal actuator cavity;

an actuation piston disposed outside the casing and within said bore so as to define a variable volume hydraulic actuation piston cavity between the casing and the actuation piston and an inner surface of said bore, the actuation piston reciprocating relative to the casing within said bore between an extended position and a collapsed position, the actuation piston configured to engage the at least one exhaust valve in the extended position of said actuation piston;

the actuation piston cavity and the actuator cavity being in fluid communication with each other through a connecting passage within the body of the casing;

a supply conduit formed within the body of the casing and connected to the connecting passage, the supply conduit adapted to provide pressurized hydraulic fluid to the actuation piston cavity through the connecting passage;

a check valve provided between the connecting passage and the actuation piston cavity, the check valve configured to hydraulically lock the actuation piston cavity when a pressure of the hydraulic fluid within the actuation piston cavity exceeds a pressure of the hydraulic fluid in the supply conduit, the check valve biased closed by a biasing spring; and a compression brake actuator disposed in the actuator cavity configured to control the check valve, wherein the compression brake actuator includes an actuator element exposed to atmospheric pressure, the actuator element slidingly mounted within the actuator cavity so as to reciprocate between an extended position and a retracted position, and wherein, a compression spring is configured to bias the actuator element toward the retracted position of the actuator element in which the actuator element engages and opens the check valve solely by the biasing force of the compression spring so as to unlock the actuation piston cavity and fluidly connect the actuation piston cavity to the supply conduit.

2. The compression brake module as defined in claim 1, wherein said single-piece body has a partially threaded outer cylindrical surface configured to engage said bore, and wherein said actuation piston includes an outer seal and smooth outer surface so as to engage, seal against, and reciprocate within said bore.

3. The compression brake module as defined in claim 1, wherein said single-piece body has a separation wall separating said actuation cavity from said actuation piston cavity.

4. The compression brake module as defined in claim 1, wherein said actuator element has a bottom face exposed to said hydraulic fluid and a top face exposed to atmospheric pressure.

5. The compression brake module as defined in claim 4, wherein said actuator cavity is closed with an end cap provided with a vent port.

6. The compression brake module of claim 1, wherein said casing further includes a groove and a retaining ring arranged within said groove, wherein said actuation piston includes an inner stopping surface, and wherein said retaining ring is configured to stop movement of said actuation piston such that said actuation piston is in the extended position when said retaining ring engages said inner stopping surface.

7. A compression brake control module, in a compression-release brake system for operating at least one exhaust valve of an internal combustion engine during a compression-release engine braking operation, the compression brake control module operatively coupled to the at least one exhaust valve for controlling a lift and a phase angle of said at least one exhaust valve, so as to maintain the at least one exhaust valve open during a compression stroke of the engine when the engine performs a compression-release engine braking operation, the compression brake control module comprising:

a casing including a single-piece body, adapted for mounting within and fixedly engaging a bore within said engine, said casing including an internal actuator cavity;

an actuation piston disposed outside the casing and within said bore so as to define a variable volume hydraulic actuation piston cavity between the casing and the actuation piston and an inner surface of said bore, the actuation piston reciprocating relative to the casing within said bore between an extended position and a collapsed position, the actuation piston configured to engage the at least one exhaust valve in the extended position of said actuation piston;

the actuation piston cavity and the actuator cavity being in fluid communication with each other through a connecting passage within the body of the casing;

a supply conduit formed within the body of the casing and connected to the connecting passage, the supply conduit adapted to provide pressurized hydraulic fluid to the actuation piston cavity through the connecting passage;

a check valve provided between the connecting passage and the actuation piston cavity, the check valve configured to hydraulically lock the actuation piston cavity when a pressure of the hydraulic fluid within the actuation piston cavity exceeds a pressure of the hydraulic fluid in the supply conduit, the check valve biased closed by a biasing spring; and a compression brake actuator disposed in the actuator cavity and configured to control the check valve, wherein the compression brake actuator includes an actuator element exposed to atmospheric pressure, the actuator element slidingly mounted within the actuator cavity so as to reciprocate between an extended position and a retracted position, and wherein a compression spring is configured to bias the actuator element toward the retracted position of the actuator element in which the actuator element engages and opens the check valve solely by the biasing force of the compression spring so as to unlock the actuation piston cavity and fluidly connect the actuation piston cavity to the supply conduit, and wherein said actuation piston includes an outer seal and smooth outer surface so as to engage, seal against, and reciprocate within said bore.

8. The compression brake module as defined in claim 7, wherein said single-piece body has a separation wall separating said actuation cavity from said actuation piston cavity.

9. The compression brake module as defined in claim 8, wherein said actuator element has a bottom face exposed to said hydraulic fluid and a top face exposed to atmospheric pressure.

10. The compression brake module as defined in claim 9, wherein said actuator cavity is closed with an end cap provided with a vent port.

11. The compression brake module of claim 7, wherein said casing further includes a groove and a retaining ring arranged within said groove, wherein said actuation piston includes an inner stopping surface, and wherein said retaining ring is configured to stop movement of said actuation piston such that said actuation piston is in the extended position when said retaining ring engages said inner stopping surface.

12. A compression brake control module, in a compression-release brake system, for use in an internal combustion engine for controlling a lift and a phase angle of at least one exhaust valve of said internal combustion engine, the compression brake control module comprising:

a casing including a single-piece body, adapted for mounting within and fixedly engaging a bore within said internal combustion engine, said casing including an internal actuator cavity;

an actuation piston disposed outside the casing and within said bore so as to define a variable volume hydraulic actuation piston cavity between the casing and the actuation piston and an inner surface of said bore, the actuation piston reciprocating relative to the casing within said bore between an extended position and a collapsed position, the actuation piston configured to engage the at least one exhaust valve in the extended position of said actuation piston;

the actuation piston cavity and the actuator cavity being in fluid communication with each other through a connecting passage within the body of the casing;

a supply conduit formed within the body of the casing and connected to the connecting passage, the supply conduit adapted to provide pressurized hydraulic fluid to the actuation piston cavity through the connecting passage;

a check valve provided between the connecting passage and the actuation piston cavity, the check valve configured to hydraulically lock the actuation piston cavity when a pressure of the hydraulic fluid within the actuation piston cavity exceeds a pressure of the hydraulic fluid in the supply conduit, the check valve biased closed by a biasing spring; and an actuator disposed in the actuator cavity and configured to control the check valve, wherein the actuator includes an actuator element exposed to atmospheric pressure, the actuator element slidingly mounted within the actuator cavity so as to reciprocate between an extended position and a retracted position, and wherein a compression spring is configured to bias the actuator element toward the retracted position of the actuator element in which the actuator element engages and opens the check valve solely by the biasing force of the compression spring so as to unlock the actuation piston cavity and fluidly connect the actuation piston cavity to the supply conduit, and wherein said single-piece body has a partially threaded outer cylindrical surface configured to engage said bore.

* * * * *